US005857216A

United States Patent [19]

Gold

[11] Patent Number: 5,857,216

[45] Date of Patent: Jan. 12, 1999

[54] PRE-CURVED GLOVES AND MITTS CONSTRUCTION AND METHODS OF CONSTRUCTION

[76] Inventor: Danny Gold, 27 Barker Road, Apt. E-2, Hong Kong, Hong Kong

[21] Appl. No.: 751,114

[22] Filed: Nov. 15, 1996

[51] Int. Cl.[6] ..... A41D 19/00

[52] U.S. Cl. ..... 2/169

[58] Field of Search ..... 2/158, 159, 161.1, 2/163, 169; 112/475.09

[56] References Cited

U.S. PATENT DOCUMENTS

| | | | |
|---|---|---|---|
| 2,433,327 | 12/1947 | Anderson | 2/169 |
| 3,056,970 | 10/1962 | Owen | 112/475.09 |
| 3,377,627 | 4/1968 | Madnick | 2/169 |
| 3,694,818 | 10/1972 | Nielson | 112/475.09 |
| 4,361,912 | 12/1982 | Arthur | 2/22 |
| 4,663,783 | 5/1987 | Obayashi | 2/161.1 |
| 4,675,253 | 6/1987 | Bowditch | 112/475.09 |
| 4,930,162 | 6/1990 | Cote | 2/163 |
| 5,600,853 | 2/1997 | Yewer, Jr. | 2/161.1 |

*Primary Examiner*—Michael A. Neas

*Attorney, Agent, or Firm*—Aufrichtig Stein & Aufrichtig, P.C.

[57] ABSTRACT

A construction method for pre-curved gloves and mittens which aids in the simplification, efficiency and repeatability of assembly. Panels of the gloves or mittens are marked, prior to assembly with lines which indicate where the gathering, darting or cut and sew reduction is to occur and how much material is to be taken in. In the cut and sew reduction the extra material between the marked lines is cut and removed prior to attachment of the lines.

27 Claims, 6 Drawing Sheets

PRE-CURVED GLOVES AND MITTS CONSTRUCTION AND METHODS OF CONSTRUCTION

BACKGROUND OF THE INVENTION

The invention is generally directed to a new construction method for pre-shaped gloves and mitts and, in particular, to a new construction method in which the gathering of the parts of the gloves or mitts required by the glove or mitt for pre-curving is accomplished in a fashion which simplifies and improves the construction of the pre-curved gloves and mitts.

In the past, pre-curved gloves have been constructed by gathering the material of the back, front or side of a glove or mitt in a fashion which causes the glove or mitt to have a pre-curved shape. Generally, when hands are kept in a relaxed state, the fingers curve inwardly rather than extending straight outwardly. As such, if gloves or mittens are designed for a flat hand, then there will be some tension on the wearer's fingers, as the hand is either forced into a straight position by the gloves or mittens or maintains pressure on the fingers as the fingers attempt to move to a curled, at rest position.

In the past, there have been various attempts to provide pre-curving to gloves and mittens and various conventional techniques for pre-curving gloves are known in the art.

One approach which has been used in boxing gloves is gathering, in which the back is cut much bigger than the palm. The sewing machine operator fits the back to the palm by gathering the excess material in the back to the palm of the glove and then sews the gathered material along a seam. This approach requires the highest degree of skill by the sewing machine operator to select how much material should be gathered and where to gather and will in any event have variations between mittens.

More recently, in connection with mittens, shirring one or more surfaces of the mitten on the inside by attaching an elastic strip to the inside of the mitten panel and thereby causing that panel to curve inwardly has been used. This approach is relatively expensive because it requires the addition of elastic and additional construction steps. Also, the sewing still requires a fairly high degree of skill to attach the elastic in the correct locations and under the correct stretchable conditions, although not as much as the boxing glove type construction. The elastic also adds a rough surface to the inside of the mitten.

Another pre-curving approach, used for World War II pilots' gloves used pre-curved fourchettes assembled to elongated backs and shortened palms. The curve on the back of the fourchette was longer than the curve on the palm side making up for the difference in size of the back and front portions. Ski gloves have also been made with this technique of using pre-curved fourchettes and sidewalls. However, the curves on the fourchettes and sidewalls are difficult to regulate and the curved pattern of the fourchettes and sidewalls can use substantial material with a large amount of waste.

In practice, the pre-curvature of gloves should be pronounced at the locations of the joints of the fingers. Particularly, the two outer joints of each finger and the outer joint of the thumb. At these locations it is essential that the glove be curved to adapt to the relaxed position of the hand and provide improved flexibility for gripping. Generally, when a sewing machine operator attempts to gather the material it requires a high degree of skill and experience. The correct amount of material must be gathered so that the dimension of the panel which is to be reduced by the Gathering is reduced by the correct amount. Also, the gathering must be done in the correct area so that the curvature is correctly located at the joints of the fingers. In practice, there is great variability from piece to piece and the desired uniformity of product is not possible, even with highly skilled sewing machine operators. Furthermore, the high experience and skill levels required by the sewing machine operators requires greater costs and expenditures finding and keeping highly skilled sewing machine operators. Also, the angle of articulation cannot be controlled and varied, with more articulation at the mid-finger joint than at the joint by the fingertip.

Accordingly, there is a need for an improved construction method or methods for pre-shaped gloves and mitts in which the pre-curvature can be implemented by darting, gathering or cutting and sewing with a visual indication of the pattern so that the pre-curved gloves and mittens can be constructed in a reproducible fashion with variability in articulation at the finger joints with relatively unskilled sewing machine operators.

SUMMARY OF THE INVENTION

The invention is generally directed to a pre-shaped glove or mitten construction.

The invention is also directed to a construction method for pre-shaped gloves and mitts in which a panel of the glove or mitt is treated so as to reduce a dimension of one side of the panel by a pre-marked visual indication for guiding the sewing machine operator in reducing the dimension by gathering, darting or cutting and sewing at or about the joints of the fingers.

It is an object of the invention to provide an improved construction and construction method for pre-shaped gloves and mittens in which a visual marking is placed on one or more panels of the gloves or mittens to guide the sewing machine operator in properly gathering, darting or cutting and sewing the pre-curved panels.

Another object of the invention is to provide an improved system for marking garment panels to aid in gathering, darting or cutting and sewing the panels for pre-curvature of the glove or mitten.

Still another object of the invention to provide an improved manner of notching or marking a back mitten piece at spaced points in order to indicate to the operator during the sewing process exactly how much material and where to gather or remove fabric to achieve a proper shape.

Still yet a further object of the invention is directed to the reduction in size of the linear measure of the back of a mitten or side panel of a glove finger wherein the darting, gathering or cutting and sewing locations are marked so as to obviate the need for highly skilled sewing machine operators.

Still another object of the invention is to provide an improved panel assembly technique for reducing the dimension of the panel to aid in the pre-curvature of a glove or mitten in which the panel is marked with visible lines to guide the sewing machine operator's activities.

Yet still another object of the invention is provide an improved pre-curved glove or mitten in which greater uniformity between pairs of gloves or mittens is achieved by pre-marked identification lines on various panels requiring gathering, darting or cutting and sewing to reduce the dimension of the panel.

Yet still a further object of the invention is to provide reduced cost of production by obviating the need for highly skilled sewing machine operators in assembling pre-curved gloves and mittens through a visual identification and guide for the operators in gathering, darting or cutting and sewing portions of the pre-curved gloves.

Still other objects and advantages of the invention will in part be obvious and will in part be apparent from the specification.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENTS

Figure 1:
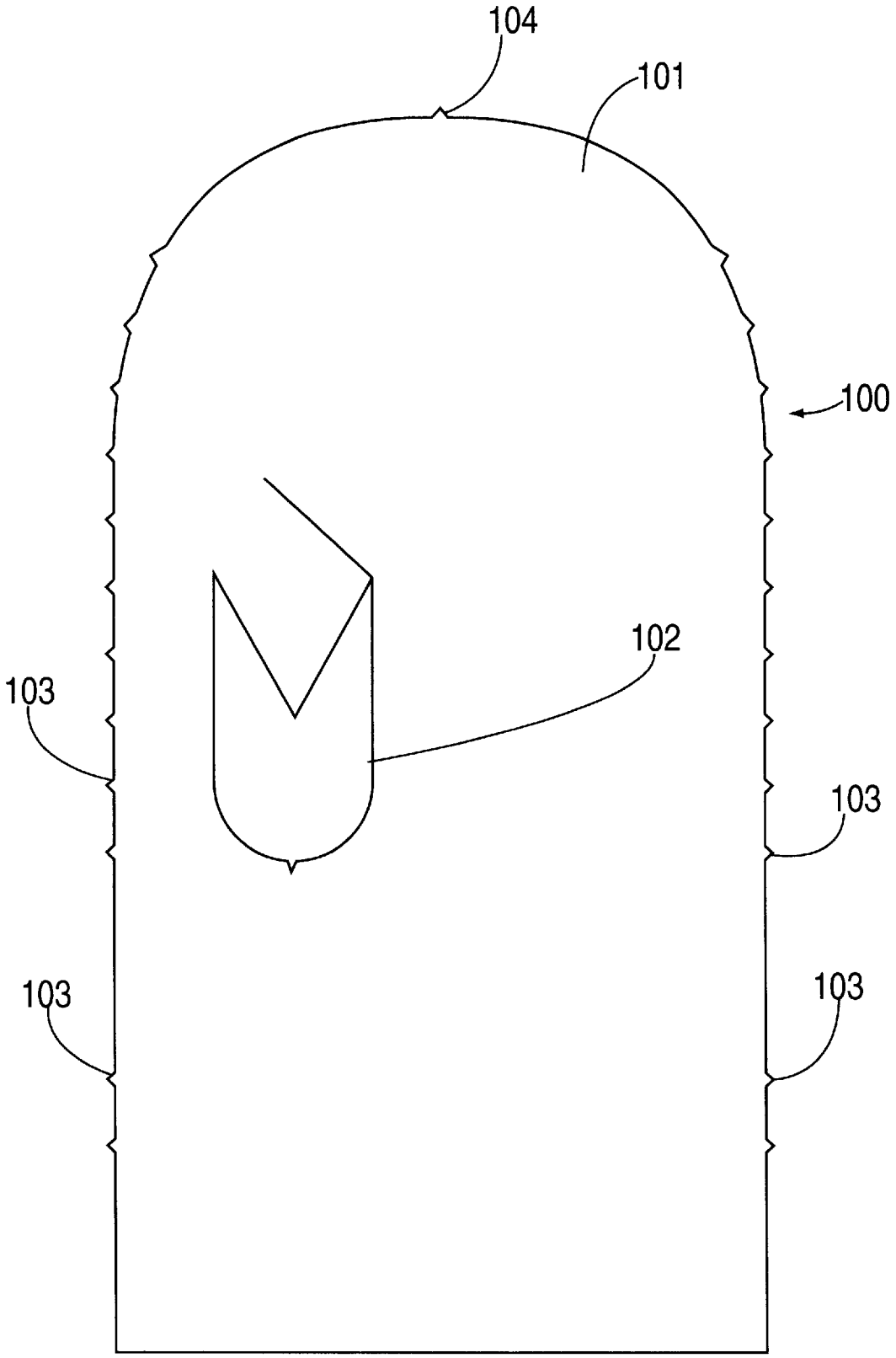
FIG. 1 is a top plan view of a mitten front panel in accordance with a preferred embodiment of the invention.
Figure 2:
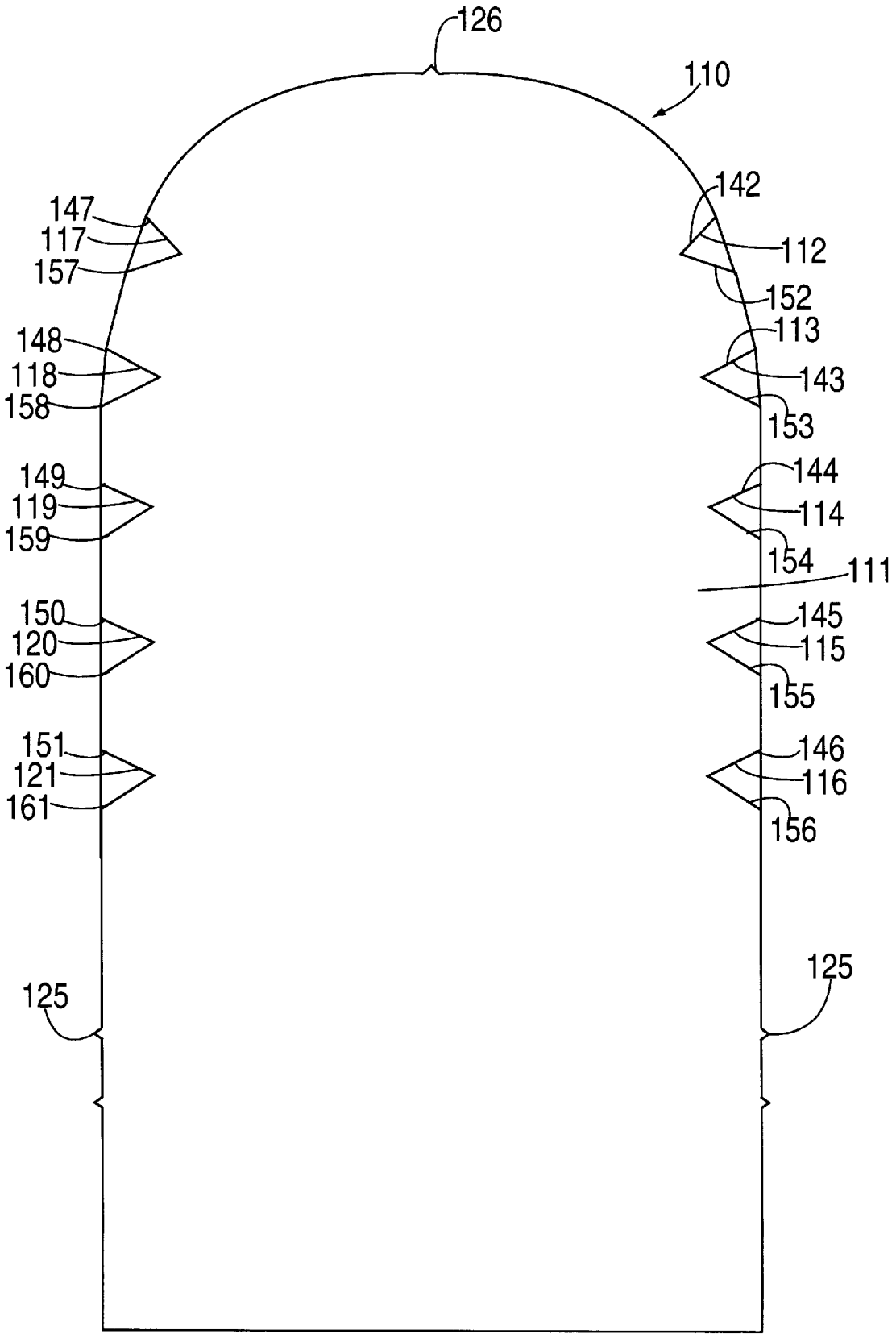
FIG. 2 is a top plan view of the back panel of a mitten constructed in accordance with a first preferred embodiment of the invention.

Reference is first made to FIGS. 1 and 2 wherein the front or palm side of a glove, generally indicated as 100, and a back side, generally indicated as 110, constructed in accordance with a preferred embodiment of the invention is depicted. The palm side 100 includes a palm panel 101 with thumb cutout 102 and alignment nibs 103 along the sides of panel 101 and alignment nib 104 at the top center of panel 101. Back portion 110 is formed of a back panel 111 having a series of marking lines 112, 113, 114, 115, 116, 117, 118, 119, 120 and 121, each of which is in the form of a V-shaped marking having the spread upper points of the "V" at the edge of back panel 111 with the bottom points of the "V" a distance away from the edge of panel 101. In addition, there are aligning nibs 125 on the sides of back panel 111 and top central aligning nib 126 in the center of the end portion of mitten back 110. Lines 112–121 are spaced and positioned to aid a sewing machine operator in the pre-assembly construction of mitten back 110.

In one preferred embodiment, the sewing machine operator gathers the area within marking 112 by sewing lines 142 and 152 together. This process is known as darting. Thereafter, the sewing machine operator likewise sews a seam connecting lines 143 and 153, lines 144 and 154, lines 145 and 155, lines 146 and 156, lines 147 and 157, lines 148 and 158, lines 149 and 159, lines 150 and 160 and lines 151 and 161. When the various lines are sewn together this has the effect of making the perimeter of mitten back 110 shorter than the distance around the panel 111 spaced inwardly from the perimeter. This causes the edges of the back panel to curve inwardly. In mitten construction, the back panel extends beyond the center line of the glove, from front to back, and mates with a smaller palm portion 101. Thus, the reduction in the perimeter length of the back panel 111 allows the larger back panel to align with the smaller front panel 101. The side nibs 103 and top center nib 104 on front panel 101 and side nibs 125 and top center nib 126 on back panel 111 are used to align front and back panels 101, 111, to form the glove. By darting back portion 110 of the mitten formed by the connection of back and front numbers 100, 110 and a thumb member (not shown) in a conventional manner a pre-curved mitten is constructed. The V-shaped sections 112–121 are marked directly on the panel and are placed in a mitten in a fashion so that a relatively constant gradual curvature to the mitten is achieved. Because the four fingers are present in a single finger stall in a mitten, the curvature cannot be localized at only one spot because the joints of the fingers are at different locations. Thus, as shown in FIG. 2, there are a series of areas of curvature which creates a gently curved profile to the mitten. In FIG. 2 there are five areas of curvature on each side of the back of the mitten, depending upon the needs of the glove and, thus, may have fewer marked areas 112–121, such as two or three or a greater number of marked areas.

Figure 3:
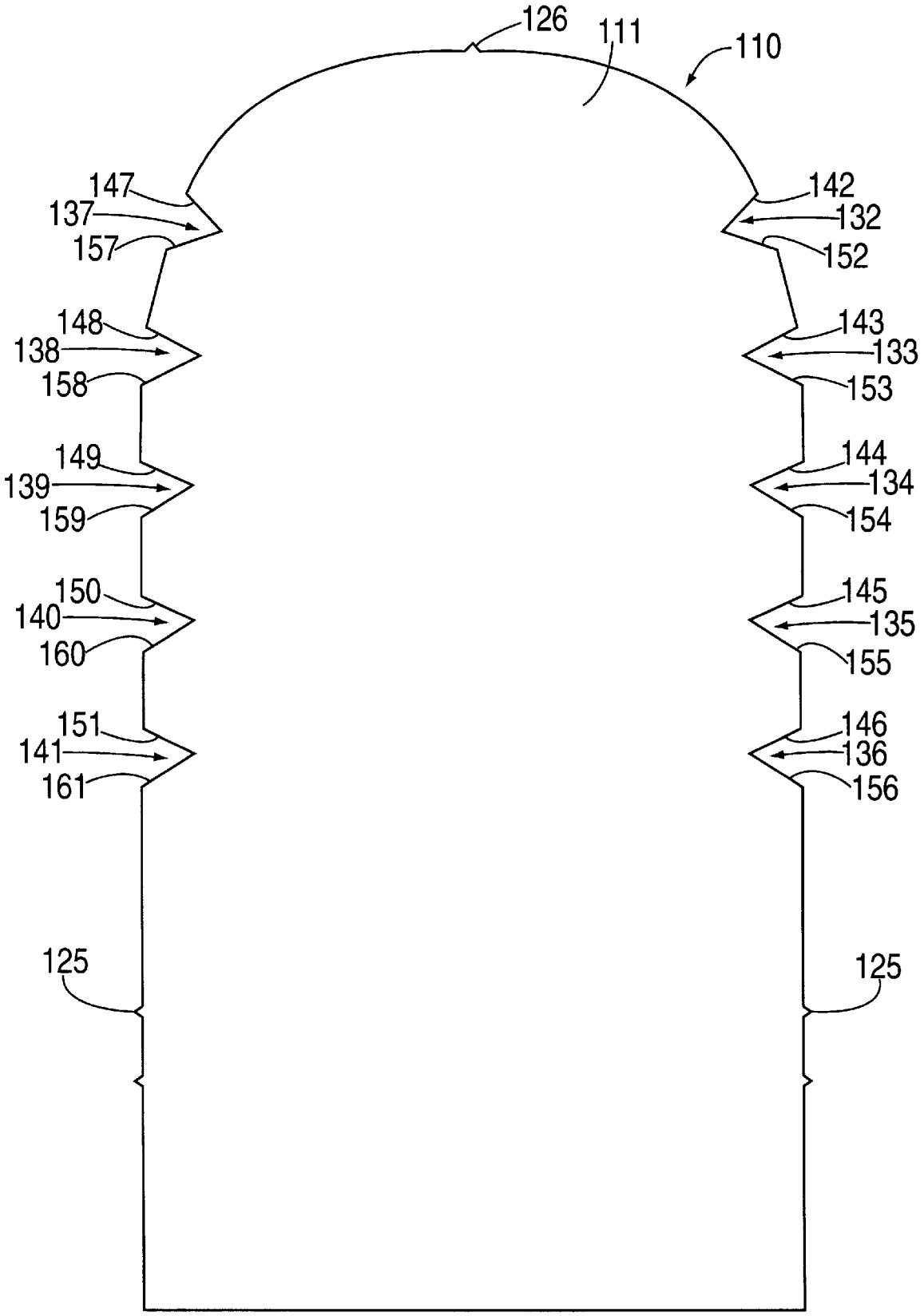
FIG. 3 is a top plan view of a back panel of a mitten back in accordance with another preferred embodiment of the invention.

One darting approach utilizes the excess material between the marked lines (i.e. as 142, 152) is gathered and collected at the back of the (inside) of back panel 111. While this generally does not interfere with the function of a mitten, in many circumstances it may be more desirable for cosmetic and functional reasons to avoid the gathered material between the marked lines. This is even more particularly relevant in connection with gloves where there is less room and the gathered material can restrict the flexibility of the fingers. Thus, reference is made to FIG. 3 wherein the areas 132–141 within marked lines 142–161 are cut out, forming V-shaped gaps 132–141. Like elements represented by like referenced numerals. Next, lines 142–151 are joined to lines 152–161, respectively, in the same fashion with the darting. This approach can be called "cut and sew". In this approach there is no excess material gathered beneath the seam connecting the adjoining line in the cutout triangular regions 132–141 following sewing. Thus, there is less interference with the flexibility of the mitten. The cut and sew approach is highly preferred where smaller panels are utilized as the darting or gathering construction approaches result in additional material present around the affected area.

Figure 4:
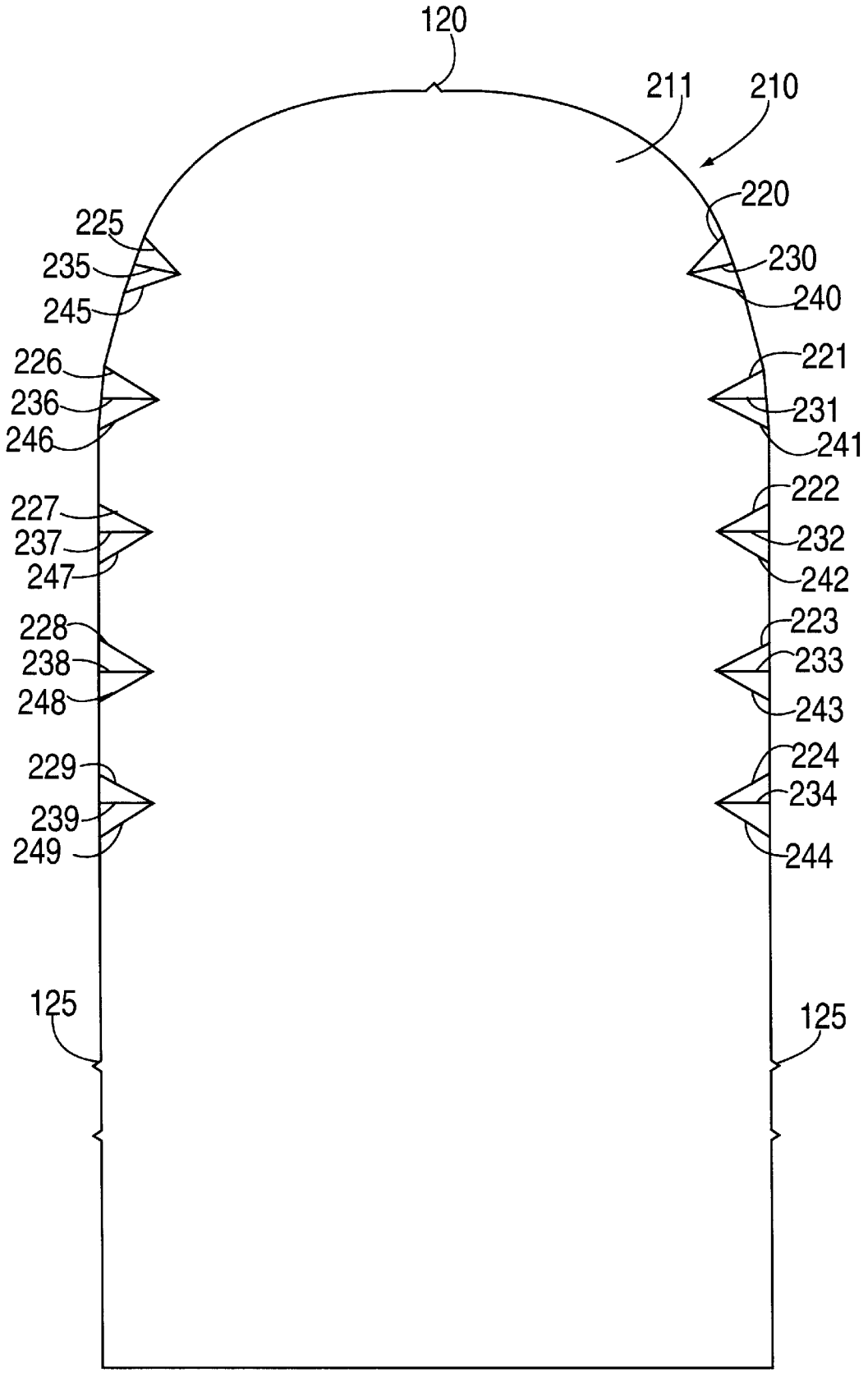
FIG. 4 is a top plan view of the back panel of a mitten constructed in accordance with a further preferred embodiment of the invention.

Reference is next made to FIG. 4 wherein an alternate embodiment of a back portion of a mitten, generally indicated as 210, constructed in accordance with another preferred embodiment of the invention is depicted. Back portion 210 includes a back panel 211 having side alignment nibs 125 and a top center alignment nib 126. In addition, there are a series of lines 220–229, 230–239 and 240–249 for gathering the perimeter of back panel 211 so as to form a pre-curved mitten. The concept of shortening the outer perimeter of the mitten is the same as in the back panels of FIGS. 2 and 3. However, in the embodiment of FIG. 4, the three lines shown are gathered by the sewing machine operator and aligned and a seam is sewn joining the three lines. For example, the sewing machine operator would gather the back panel 211 of the mitten by placing lines 220, 230 and 240 together, with the material therebetween gathered. Then, a seam would be stitched along the length of lines 220, 230 and 240 through the three layers of material. Likewise, this process would be repeated for lines 221, 231 and 241, as well as the other groupings of three marked lines. No skilled technique is required as the sewing machine operator need only gather the groups of three lines together and sew a seam along the three lines. By pre-marking the lines, the sewing machine operators need not exercise any of their own initiative or experience in connection with the gathering and a uniform product is achieved through a production run independent of the variations in skill and experience between different sewing machine operators.

Figure 5:
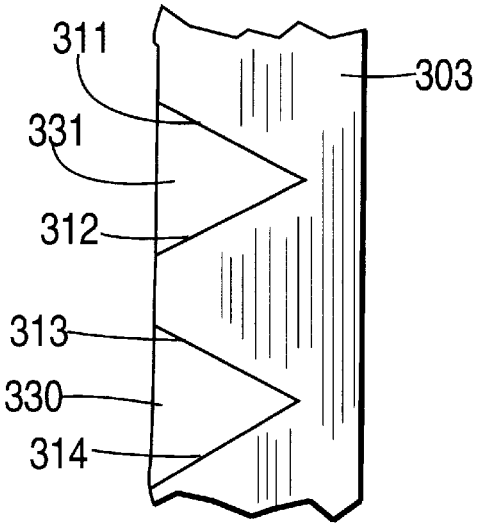
FIG. 5 is a partial side elevational view of a side panel of a pre-curved glove in accordance with a preferred embodiment of the invention.
Figure 6:
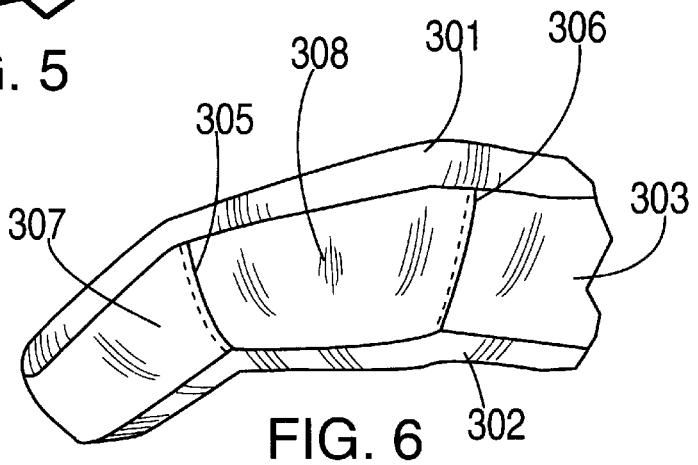
FIG. 6 is a cutaway front elevational view of a side of a glove finger constructed in accordance with a preferred embodiment invention.
Figure 7:
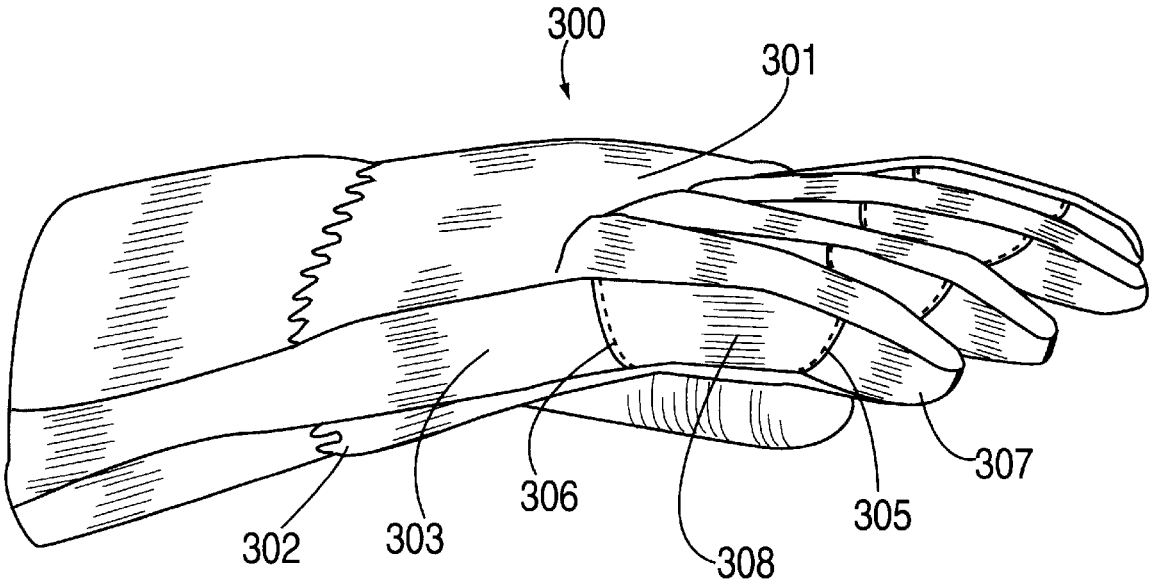
FIG. 7 is a perspective view of a glove constructed in accordance with a preferred embodiment of the invention.

Reference is next made to FIGS. 5, 6 and 7, wherein a pre-curved glove, generally indicated as 300 constructed in accordance with a preferred embodiment of the invention is depicted, like reference numerals representing like elements. As shown in FIG. 7, glove 300 includes a back panel 301, palm panel 302 and finger side panels 303. These components are assembled with stitching in an inverted fashion so that when the glove is fully constructed it can be inverted so that the seams are hidden on the inside of the glove in accordance with conventional glove making technology. Side panel 303 includes two cut and sew seams 305, 306, positioned at the last two joints of the finger, creating end portion 307 and middle portion 308 in side panel 303.

FIG. 5 shows the side panel 303 prior to its pre-assembly. FIG. 6 merely shows a cutaway version covering cut and sew seams 305, 306, after assembly. Side panel 303 includes marked lines 311, 312 defining a cutout area 331 and marked lines 313, 314 defining a cutout area 330. In practice, where the cut and sew approach is utilized, the worker would cut side panel 303 along lines 311 and 312 to remove area 331 and likewise cut along lines 313 and 314 to remove area 330. Thereafter, lines 311 and 312 would be gathered together and a stitching line 305 is made. Likewise, following removal of area 330, lines 313 and 314 are overlaid and stitching line 306 is added. In practice, the lines are overlaid with a minimal margin to provide room for the seam in accordance with standard sewing machine operation.

As seen in FIG. 5, the cutout areas 330 and 331 do not extend completely across the width of side panel 303. Rather, a small portion beyond the point of areas 330, 331 is uncut so that the seam connecting the right portion of side panel 303 (in FIG. 5) to top panel 301 is stable and secure. FIG. 5 is not drawn to scale and in practice the width of the region beyond the point of cutout areas 330, 331 is generally no more and usually slightly less than the clearance between the seam and the edge of the strip 303. Because of the consistent nature of the pre-assembly of side panels 303, which may either be panels that extend around the fingertips and down the other side of the glove, or merely fourchettes which extend from the crotch of the finger to or near the tip of the finger, the pre-curvature in these side panels is efficiently achieved. By use of the cut and sew construction method with pre-marked lines for cutting and sewing, the regions of pre-curvature are created at the finger joints, where they are needed, and there is consistent and constant pre-curvature without the need for the sewing machine operators to be experienced and skilled in gathering or darting, and without the need for the sewing machine operators to select the appropriate areas at which to gather or dart the side panels.

While the drawings of FIGS. 5, 6 and 7 highlight the cut and sew construction method where the lines are pre-drawn to instruct and guide the workers involved in the construction process, both the darting and gathering methods described above in respect to FIGS. 2 and 4 can also be utilized. In the event that the darting approach is utilized, the identical pattern marked on side pane 303 would be utilized. However, rather than cutting out triangular areas 330, 331, the sewing machine operator would merely align lines 311, 312 and stitch a seam along these lines. The material of area 331 would be gathered behind the seam lines. While this has the effect of restricting the flexibility of the gloves and placing additional material within the glove that is unnecessary, this construction has the positive attribute of reducing a step from the assembly process, i.e. the cutting phase. Likewise, instead of utilizing the lines 311, 312, a multi-line gathering pattern can be marked on side panel 303, as shown in FIG. 4, in which the sewing machine operator would gather the various lines and then add a stitch along the aligned lines.

The marking can be done in a variety of ways. The marking can be done with an ink which is either erasable or not, chalk or similar temporary marking, other permanent or semi-permanent marking approaches. The marking line may be put on by a stencil or similar master guide. Also, when the fabric or other material used for the panels is sized and marked for cutting into panels, the same marking can be applied for the pre-curving feature.

In the event that the cut and sew approach is indicated, when a series of fabric pieces are cut to size in a single stack, the cutter makes the cuts for purposes of pre-curvature in accordance with the indicated pattern. In this way, the sewing machine operator need not perform any functions except the connection of seams in a predetermined and preplanned fashion.

Figure 8:
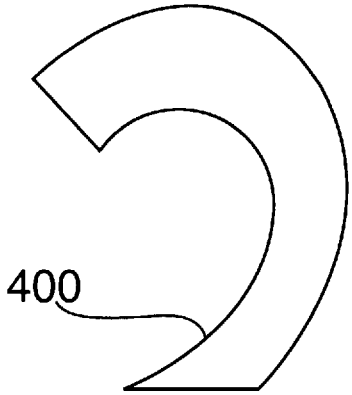
FIG. 8 PRIOR ART
FIG. 8 is a top plan view of a fourchette or sidewall of a pre-curved glove in accordance with the prior art.
Figure 9:
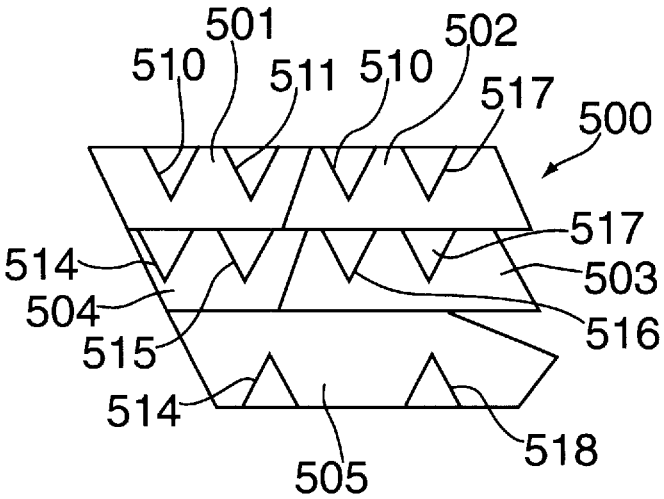
FIG. 9 is a top plan view of a series of fourchettes and sidewalls in accordance with a preferred embodiment of the invention.

Reference is next made to FIG. 8 wherein the prior art curved fourchette method of pre-curving is identified and FIG. 9 in which the advantages of the cut and sew method are shown. In FIG. 8, a side panel or fourchette pattern 400 in accordance with the prior art pre-shaping technique is shown. Fourchette or side panel 400 is curved and, due to its shape, results in substantial wasted material which must be discarded. In addition, it is difficult, sewing these curved fourchettes or side panels to control the degree and location of glove articulation, even with a highly skilled sewing machine operator.

In contrast, with reference to FIG. 9, a series of fourchettes and sidewalls are shown in pattern 500. Pattern 500 includes fourchette and sidewall pieces 501, 502, 503, 504 and 505. As apparent, because of the straight line construction of these components, the angled ends may be nested such as in panels 501 and 502 and adjacent strips 501, 502 and 503, 504. This efficiency and higher degree of utilization of the material than in the prior art curved fourchettes or sidewalls saves considerable money on fabrics and also avoids the need to make difficult curved cuts in the fabrics. The curved cuts are more difficult and time consuming and, again, are more likely to have irregularities and variations between cuts made on different pieces due to human and machine difficulties with the curved surfaces. The side panels and fourchettes 501–505 have a series of marking lines 510, 511, 512, 513, 514, 515, 516, 517, 518 and 519. The placement of the cut and sew markings can be varied to properly align with the finger joints. In addition, the degree of articulation or curvature can be adjusted by varying the width of the marking at the open end of the "V". To the extent that the "V" is made wider, there is more articulation and curvature at the spot than where the "V" is made narrower and less articulation is present. This is important because the joint closest to the finger tip generally requires less articulation than the second joint, closer to the hand.

While this construction approach has been described with respect to gloves and mittens, it may likewise be utilized in connection with other types of garments or constructions which require gathering in their assembly. Also, while stitching has been highlighted as the preferred attachment method, other conventional attachment techniques such as gluing, stapling, ultrasonic energy and the like may be used in accordance with the invention.

Accordingly, an improved construction method for pre-curved gloves and mitts is presented in which the pre-curvature is implemented by pre-marking of indicated areas where seams and/or cuts are to be made so that the sewing machine operator need not rely upon experience or estimation to select appropriate areas for gathering or darting to form the pre-curvature of the glove or mitten. This construction approach minimizes the need for a skilled sewing machine operator and likewise insures that each of the gloves or mittens is identically constructed with the same desired degree and location of pre-curvature.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A construction method for a pre-curved glove, comprising:

marking at least a front panel, back panel, side walls and fourchettes on at least one sheet of material for assembly into the pre-curved glove;

marking portions of the side walls and fourchettes requiring articulation to create a pre-curved shape and mate with the front and back panels;

separating the panels from the sheet of material;

connecting the marked portions of the side walls and fourchettes to each other to effect an articulation of the side walls and fourchettes at the marked portions; and assembling the front and back panels and the side walls and fourchettes to form the pre-curved glove.

2. The construction method of claim 1 wherein the side walls and fourchettes are marked to be articulated at the joints of the fingers.

3. The construction method of claim 1 wherein the marking of the side walls and fourchettes is varied to make the articulation of the second joint from the fingertips greater than the articulation of the first joint from the fingertips.

4. The construction method of claim 1 further including cutting the marked portions of the side walls and fourchettes prior to assembling to the panels.

5. The construction method of claim 4 wherein the cut, marked portions of the side walls and fourchettes are connected to each other by sewing them along the marked and cut edges.

6. The construction method of claim 1 wherein the marking of the side walls and fourchettes is made in a V-shaped fashion with the spread points on an edge of a side wall or fourchette.

7. A construction method for a pre-curved garment, comprising:

marking panels on a sheet of material for assembly into the garment;

marking portions of the panels requiring a reduction in a dimension of a panel;

separating the panels from the sheet of material;

connecting the marked portions of a panel to each other to effect a reduction in the dimension of the panel; and assembling the panels to form the garment.

8. The construction method of claim 7 wherein the portions of the panels requiring reduction are marked with lines on the panel showing where the reduction in the dimension of the panel should occur and how much reduction is required.

9. The construction method of claim 8 wherein the lines on the panel are aligned and then connected to each other.

10. The construction method of claim 9 wherein the lines are connected to each other by sewing.

11. The construction method of claim 7, further including removing the area of the panel which is marked prior to connecting the marked portions.

12. The construction method of claim 11 wherein the marked area of the panel is removed by cutting out the marked portions.

13. The construction method of claim 7 wherein the marked portions of the panel are connected to each other by darting the marked portions.

14. The construction method of claim 7 wherein the marked portions of the pane are connected to each other by gathering the marked portions.

15. A construction method for a pre-curved glove or mitten, comprising:

marking panels on a sheet of material for assembly into the glove or mitten;

marking portions of the panels requiring a reduction in a dimension of a panel;

separating the panels from the sheet of material;

connecting the marked portions of a panel to each other to effect a reduction in the dimension of the panel; and assembling the panels to form the glove or mitten.

16. The construction method of claim 15 wherein the portions of the panels requiring reduction are marked with lines on the panel showing where the reduction in the dimension of the panel should occur and how much reduction is required.

17. The construction method of claim 16 wherein the lines on the panel are aligned and then connected to each other.

18. The construction method of claim 17 wherein the lines are connected to each other by sewing.

19. The construction method of claim 15, further including removing the area of the panel which is marked prior to connecting the marked portions.

20. The construction method of claim 19 wherein the marked area of the panel is removed by cutting out the marked portions.

21. The construction method of claim 15 wherein the marked portions of the panel are connected to each other by darting the marked portions.

22. The construction method of claim 1 wherein the marked portions of the pane are connected to each other by gathering the marked portions.

23. A construction method for a pre-curved glove, comprising:

marking at least a front panel, back panel, side walls and fourchettes on at least one sheet of material for assembly into the pre-curved glove;

marking portions of the side walls and fourchettes requiring articulation to create a pre-curved shape and mate with the front and back panels, wherein the marking of the side walls and fourchettes is varied to make the articulation of the second joint from the fingertips greater than the articulation of the first joint from the fingertips;

separating the panels from the sheet of material;

connecting the marked portions of the side walls and fourchettes to each other to effect an articulation of the side walls and fourchettes at the marked portions; and assembling the front and back panels and the side walls and fourchettes to form the pre-curved glove.

24. The construction method of claim 23 wherein the side walls and fourchettes are marked to be articulated at the joints of the fingers.

25. The construction method of claim 23 further including cutting the marked portions of the side walls and fourchettes prior to assembling to the panels.

26. The construction method of claim 25 wherein the cut, marked portions of the side walls and fourchettes are connected to each other by sewing them along the marked and cut edges.

27. The construction method of claim 23 wherein the marking of the side walls and fourchettes is made in a V-shaped fashion with the spread points on an edge of a side wall or fourchette.

* * * * *